US007980105B2

(12) United States Patent
Yang

(10) Patent No.: US 7,980,105 B2
(45) Date of Patent: Jul. 19, 2011

(54) WAFER-TYPE TUMBLER CYLINDER

(76) Inventor: Cheng-Ju Yang, Taipei (TW)

( * ) Notice: Subject to any disclaimer, the term of this patent is extended or adjusted under 35 U.S.C. 154(b) by 0 days.

(21) Appl. No.: 12/716,367

(22) Filed: Mar. 3, 2010

(65) Prior Publication Data

US 2010/0300164 A1 Dec. 2, 2010

(30) Foreign Application Priority Data

May 27, 2009 (TW) ..... 98209351 U

(51) Int. Cl.
*E05B 29/06* (2006.01)

(52) U.S. Cl. ..... 70/375; 70/492; 70/DIG. 15

(58) Field of Classification Search ..... 70/375, 70/492, 495, 377, 392, 420, 453, DIG. 15, 70/DIG. 25, DIG. 37, DIG. 54
See application file for complete search history.

(56) References Cited

U.S. PATENT DOCUMENTS

| | | | | | |
|---|---|---|---|---|---|
| 2,453,066 | A * | 11/1948 | Gabrielsen | 70/385 |
| 3,707,863 | A * | 1/1973 | Schwab et al. | 70/492 |
| 3,722,241 | A * | 3/1973 | Sussina | 70/495 |
| 3,881,333 | A * | 5/1975 | Christmas | 70/492 |
| 3,988,912 | A * | 11/1976 | Rogers | 70/492 |
| 4,052,870 | A * | 10/1977 | Degeye et al. | 70/492 |
| 4,069,693 | A * | 1/1978 | Spalding | 70/492 |
| 5,454,246 | A * | 10/1995 | Mueller | 70/495 |
| 6,119,495 | A * | 9/2000 | Loreti | 70/340 |
| 7,007,528 | B2 * | 3/2006 | Chong et al. | 70/492 |
| 7,484,392 | B2 * | 2/2009 | Katagiri | 70/492 |
| 7,530,246 | B2 * | 5/2009 | Yang | 70/492 |
| 7,762,111 | B2 * | 7/2010 | Damikolas et al. | 70/375 |
| 2003/0037582 | A1 * | 2/2003 | Edwards et al. | 70/495 |
| 2005/0039507 | A1 * | 2/2005 | Armstrong et al. | 70/492 |
| 2005/0217330 | A1 * | 10/2005 | Chong et al. | 70/492 |
| 2006/0101880 | A1 * | 5/2006 | Ward-Dolkas et al. | 70/492 |
| 2007/0089468 | A1 * | 4/2007 | Chong et al. | 70/383 |
| 2007/0151316 | A1 * | 7/2007 | Bardachenko | 70/492 |

* cited by examiner

*Primary Examiner* — Lloyd A Gall

(57) ABSTRACT

A wafer-type tumbler cylinder comprises a sleeve, a cylinder, a plurality of first and second wafers, some springs and some U-shaped fixtures. The wafer-type tumbler cylinder is an integral cylindrical shaft having indentations, fixing slots and riveting plates made in a consistent operation. After the placement of every pair of first and second wafers and one shared spring into the cylindrical shaft, the riveting plates are pressed into a horizontal position to secure the wafers and spring; furthermore, all the indentations, first and second wafers, springs and riveting plates are installed on one side, or on both sides of the cylindrical shaft. The improved structure of riveting plates, U-shaped fixtures and shared spring for every pair of first and second wafers enables the key to move forward and backward smoothly, and also enables the users to lock and unlock easily and successfully.

2 Claims, 5 Drawing Sheets

WAFER-TYPE TUMBLER CYLINDER

BACKGROUND OF THE INVENTION

1) Field of the Invention

The invention relates to a wafer-type tumbler cylinder, a cylindrical shaft, the indentations, fixing slots and riveting plates of which are made in a consistent integrated operation, thereby facilitating the placement of first and second wafers and springs in the indentations and, furthermore, one spring serves as a shared spring for every pair of first and second wafers. In addition to reducing the material cost of the spring, one pair of first and second wafers is disposed in each indentation so as to increase the difficulty of prying or unlocking by burglars. The improved structure of riveting plates and shared spring for every pair of first and second wafers enables the key to move forward and backward smoothly, and also enables the users to lock and unlock easily and successfully.

2) Description of the Prior Art

A conventional wafer-type tumbler cylinder, as shown in FIG. 5, mainly comprises a sleeve 1*a*, a cylinder 2*a*, some wafers 3*a* and some springs 4*a*. The sleeve 1*a* has a bore 11*a* extending through it lengthwise; the cylinder 2*a* has a flange 22 and a drive section 23 at the front and rear ends; the cylinder 2*a* is a cylindrical shaft 20*a* with several diametrically rectangular through-holes 24*a* and, furthermore, at the two sides of each rectangular through-hole 24*a* is a C-shaped recess 25 and a horizontally oriented U-shaped recess 26 (as shown in FIGS. 6 and 7), for the installation of wafer 3*a* and spring 4*a* sets.

Each wafer 3*a* of the conventional wafer-type tumbler cylinder, in addition to a window 31 in the middle of each wafer body 30, has an opposing spring tab 32 and a locating tab 34; when the wafer 3*a* is inserted into each rectangular through-hole 24*a* on the shaft 20*a* of the cylinder 2*a*, it is first necessary to install a spring 4*a* into the C-shaped recess 25 at one side of the rectangular through-hole 24*a*, following which the wafer 3*a* is then inserted into the rectangular through-hole 24*a*; but during the installation, since the wafer body 30 of the wafer 3*a* has the spring tab 32, its insertion occurs without any resistance along the C-shaped recess 25; however, the locating tab 34, disposed in the other side of the wafer body 30, must similarly undergo insertion through the C-shaped recess 25 along the rectangular through-hole 24*a*, and, as a result, friction occurs along the interior wall of the rectangular through-hole 24*a* at the opposite lateral of the C-shaped recess 25, and only after this does the locating tab 34 of the wafer body 30 reach into the horizontally oriented U-shaped recess 26, where it becomes nested onto the bottom of the horizontally oriented U-shaped recess 26 (as indicated in FIGS. 6 and 7), and also only then is the cylinder 2*a* installed in the bore 11*a* of the sleeve 1*a*, which completes the assembly of one wafer-type tumbler mechanism. As such, during the insertion of each wafer 3*a* into the rectangular through-hole 24*a* on the shaft 20*a*, the operation is difficult and adversely affects the production process. After each wafer 3*a* has been inserted into the rectangular through-hole 24*a*, the locating tab 34 on the wafer body 30 is nested onto the bottom of the horizontally oriented U-shaped recesses 26; however, the height of the locating tab 34 is quite limited and, furthermore, the locating tab 34 is subjected to the outwardly exerted elastic force of the spring 4*a*, thus the wafer 3*a* is often ejected out of the rectangular through-hole 24*a*. Such situation results in a troublesome and inconvenient assembly operation as the cylinder 2*a* is inserted into the bore 11*a* of the sleeve 1*a*, which likewise adversely affects the production process.

In view of such inconveniences and shortcomings during the process of production and assembly operation for the conventional wafer-type tumbler cylinder, the inventor filed a patent application entitled "Wafer-type tumbler cylinder and key" that has been issued as U.S. Pat. No. 7,530,246 B2 on May 12, 2009. The above-mentioned patent not only provides a cylinder for better placement of wafers and springs, but also provides a cylinder with a corrugated-contour keyway having a structure of one shared spring for every two wafers, thereby preventing theft by means of a metal sheet or other equivalent tool inserted for burglarizing. Even though such patent provides a better invention of wafer-type tumbler cylinder and key and many users have good opinions, the inventor still continues to conduct research and development on wafer-type tumbler cylinder and thus results in this improved wafer-type tumbler cylinder with riveting plates and better cylindrical shaft made in a consistent integrated operation.

SUMMARY OF THE INVENTION

The objective of the invention herein is to provide a wafer-type tumbler cylinder having a cylindrical shaft and the cylindrical shaft comprises a plurality of indentations, a plurality of fixing slots and a plurality of riveting plates. After the placement of one pair of first and second wafers and one shared spring into each of the indentations, each of the riveting plates disposed on the outer sides of the indentations is pressed into a horizontal position to secure the wafers and spring; furthermore, a U-shaped fixture is fixed in each of the fixing slots such that the assembly of improved wafer-type tumbler cylinder is complete and the assembly cost is reduced as well because each pair of first and second wafers is supported by a shared spring.

To achieve another objective of the invention herein, the cylindrical shaft of the cylinder, indentations, fixing slots and riveting plates are made in a consistent operation into an integral cylindrical shaft wherein all the indentations, first and second wafers, springs and riveting plates are installed on one side or on both sides of the cylindrical shaft. Such improved structure enables the key to move forward and backward more smoothly, and also enables the users to lock and unlock more easily. Besides, it's able to prevent from prying effectively because a burglar can not pry a pair of first and second wafers supported by a shared spring with a metal plate or other equivalent tool.

BRIEF DESCRIPTION OF THE DRAWINGS

FIGS. 3-1 is a vertically sectional view, as viewed from a perspective in FIG. 3.

FIGS. 4-1 is a vertically sectional view, as viewed from a perspective in FIG. 4.

DETAILED DESCRIPTION OF THE PREFERRED EMBODIMENTS

Figure 1:
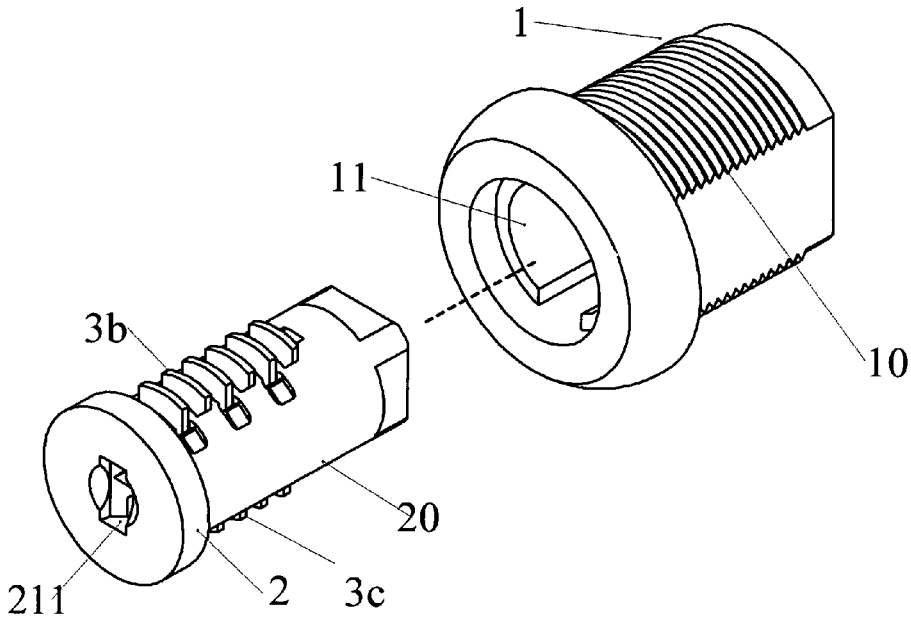
FIG. 1 is an isometric drawing of the wafer-type tumbler cylinder in the present invention.
Figure 2:
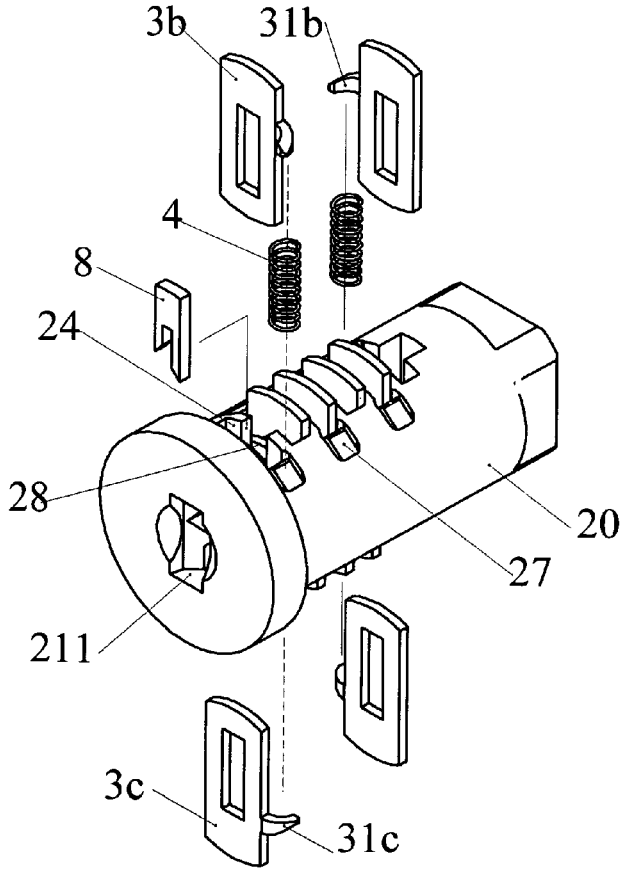
FIG. 2 is an exploded drawing of the wafer-type tumbler cylinder in the present invention.

FIGS. 1 and 2 are isometric and exploded drawings of the wafer-type tumbler cylinder in the present invention. A wafer-type tumbler cylinder of the invention herein includes a sleeve 1, a cylinder 2, a plurality of first wafers 3*b*, a plurality of second wafers 3*c*, a plurality of springs 4, and a plurality of U-shaped fixtures 8. The structure of the sleeve 1 and the method for installing with the cylinder 2 are the same as those of said conventional wafer-type tumbler. There is no need to go into details.

Figures 1, 3:
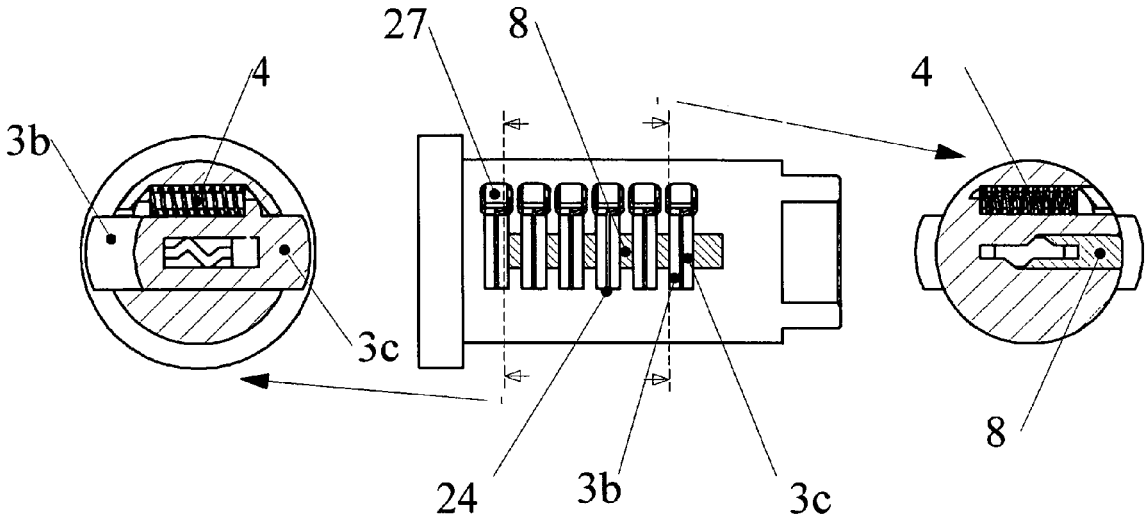
FIG. 3 is an isometric drawing of the present wafer-type tumbler cylinder, riveting plates of which are made on either left or right side thereof in a consistent operation.
Figure 3:
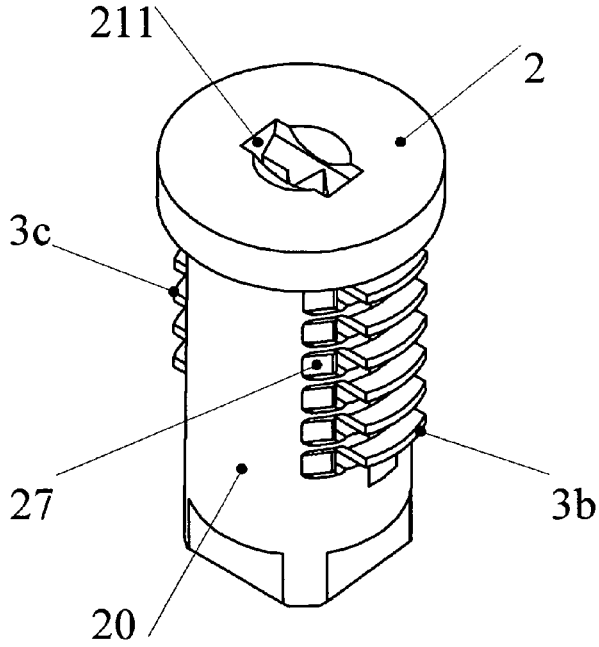
Figures 1, 4:
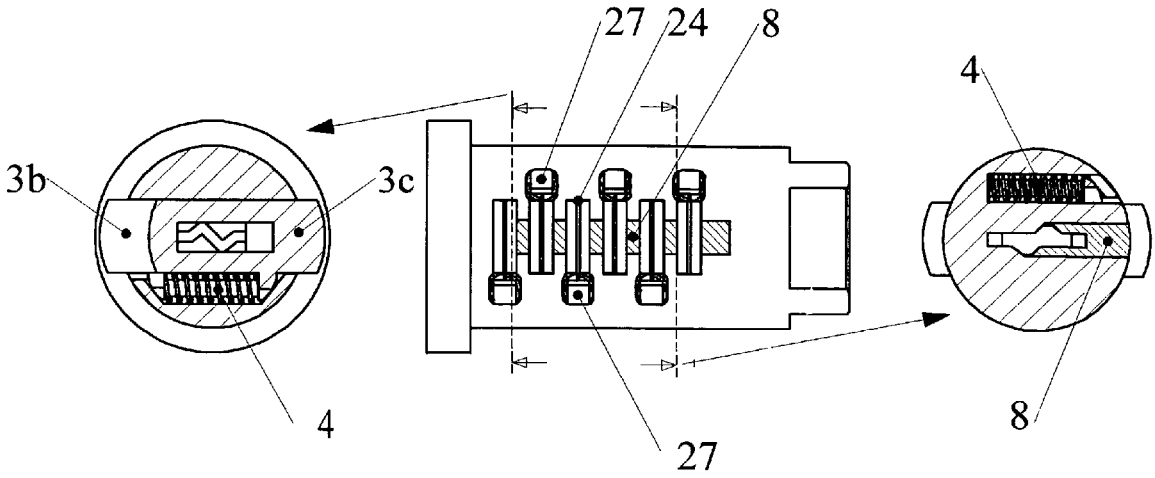
FIG. 4 is an isometric drawing of the present wafer-type tumbler cylinder, riveting plates of which are made on both left and right sides thereof in a consistent operation.
Figure 4:
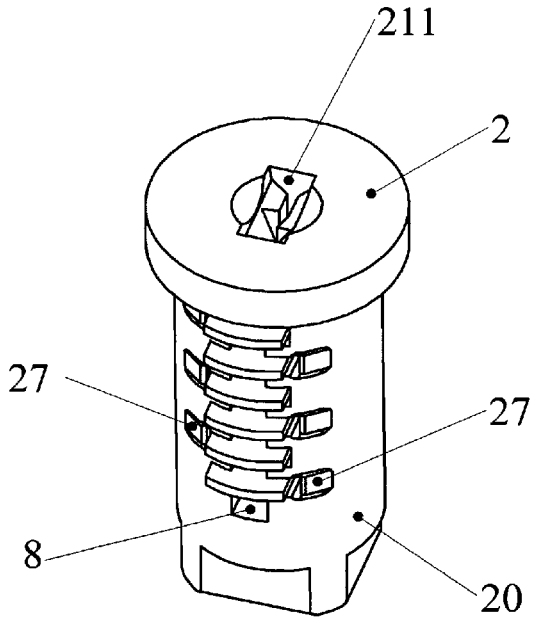
Figure 5:
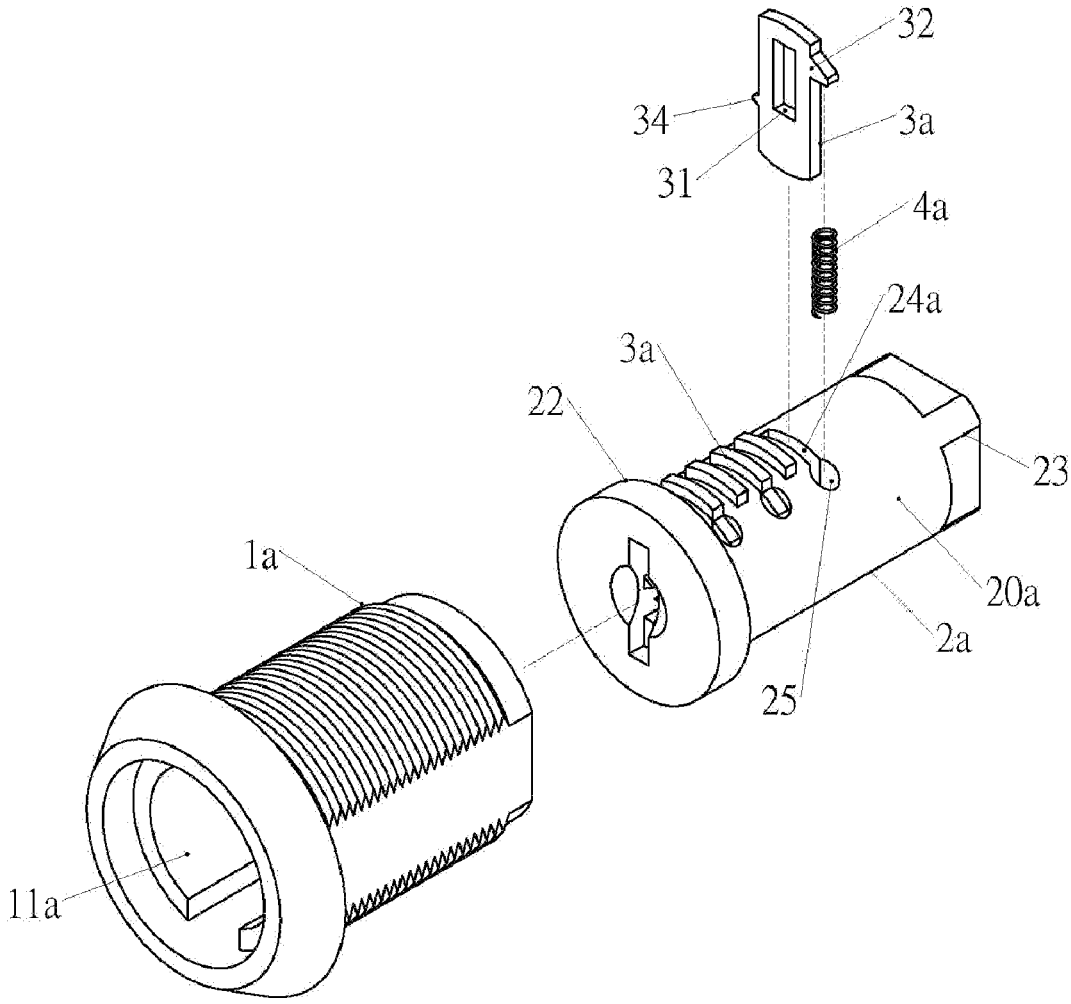
Fig. 5 PRIOR ART
FIG. 5 is an exploded drawing of the conventional wafer-type tumbler cylinder.
Figure 6:
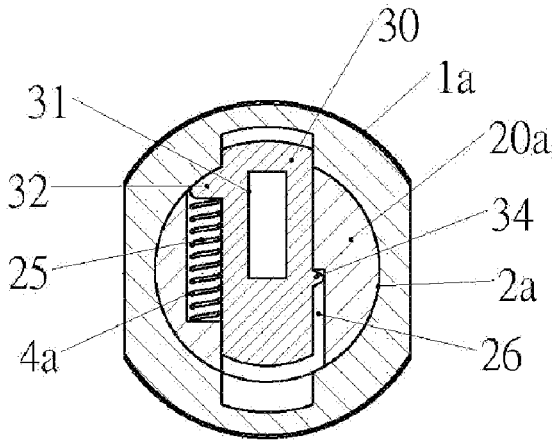
Fig. 6 PRIOR ART
FIG. 6 is a cross-sectional drawing of the conventional wafer-type tumbler installed with a wafer and a spring.
Figure 7:
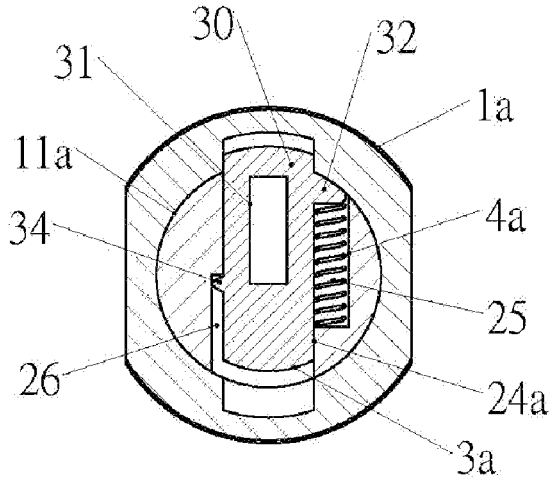
Fig. 7 PRIOR ART
FIG. 7 is a cross-sectional drawing of the conventional wafer-type tumbler installed with another wafer and spring adjacent to the wafer and spring, as viewed from a perspective in FIG. 6

Please refer to FIG. 3, FIGS. 3-1, FIG. 4 and FIGS. 4-1 for isometric drawings and vertically sectional views of the present invention, the riveting plates and an integral cylindrical shaft of which are made in a consistent operation. The wafer-type tumbler cylinder of the invention is an integral cylindrical shaft 20 having a plurality of indentations 24, a plurality of fixing slots 28 and a plurality of riveting plates 27 (all of the indentations 24, fixing slots 28, riveting plates 27 and cylindrical shaft 20 are made in a consistent operation. At first, one of the second wafers 3*c* is disposed in one of the indentations 24, and one spring 4 is nested against a second wafer tab 31*c*, as shown in FIG. 2; then one of the first wafers 3*b* is disposed in the one indentation and therefore, a first wafer tab 31*b* is nested upon the top of the spring 4, as shown in FIG. 2, such that each pair of first and second wafers 3*b*, 3*c* is supported by the shared spring 4 respectively. Each of the riveting plates 27 disposed on the outer sides of the indentations 24 is pressed into a horizontal position to firmly secure the pair of first and second wafers 3*b*, 3*c* and the spring 4; afterwards, a U-shaped fixture 8 is fixed in a fixing slot 28 which is an interconnected slot between every two of the indentations 24. Moreover, two pairs of first and second wafers 3*b*, 3*c* and two springs 4 are securely fixed in two of the indentations 24 because of the fixation of one U-shaped fixture 8 into the fixing slot 28, thereby preventing from prying effectively. As a result, in addition to lowering the cost of the springs, the wafer-type tumbler cylinder of the invention has a better burglarproof advantage due to the installation of the spring 4 shared by the first and second wafers 3*b*, 3*c* and the installation of the U-shaped fixture 8 into the fixing slot 28.

As shown in FIGS. 4 and 4-1, the indentations 24, first and second wafers 3*b*, 3*c*, springs 4 and riveting plates 27 are disposed on both sides of the cylindrical shaft 20; likewise, all of the indentations, first and second wafers, springs and riveting plates are disposed on one side thereof, as illustrated in FIGS. 3 and 3-1; such improved structure enables the key to move forward and backward more smoothly, and also enables the users to lock and unlock more easily. Besides, it's able to prevent from prying effectively because a burglar can not pry a pair of first and second wafers supported by a shared spring with a metal plate or other equivalent tool. Therefore, this improved wafer-type tumbler cylinder is inventive since a plurality of pairs of first and second wafers increase the difficulty of prying or unlocking by burglars; when the burglar tries to prize the first wafer in the indentation, the second wafer in the same indentation is immediately locked by means of the elastic force of the shared spring.

What is claimed is:

1. A wafer-type tumbler cylinder comprising a sleeve, a cylinder, a plurality of first wafers, a plurality of second wafers, a plurality of springs, and a plurality of U-shaped fixtures, the cylinder being a cylindrical shaft having a plurality of indentations, a plurality of fixing slots and a plurality of riveting plates, wherein each of said indentations is installed with one of said first wafers, one of said springs and one of said second wafers; wherein each of said fixing slots is an interconnected slot between every two of said indentations for the insertion of one of said U-shaped fixtures; wherein the riveting plates and the cylindrical shaft of the cylinder are made in a consistent operation, and the riveting plates are disposed on the outer sides of said indentations; wherein each of said first wafers includes a first wafer tab; each of said second wafers includes a second wafer tab; and each of said U-shaped fixtures is fixed into each of said fixing slots; wherein at first one of said second wafers is placed into one of said indentations of the cylindrical shaft of the cylinder, and then one of said springs and one of said first wafers are placed into the one of said indentations in sequence such that the one of said springs is fixed between said first wafer tab and said second wafer tab, and the riveting plates are pressed into a horizontal position so that each of said first and second wafers and each of said springs are firmly fixed in each of said indentations, and then the U-shaped fixtures are fixed into said fixing slots respectively so that two of said first wafers, two of said second wafers and two of said springs are firmly fixed in every two of said indentations because of the insertion of one U-shaped fixture into one fixing slot, thereby preventing from prying effectively.

2. The wafer-type tumbler cylinder of claim 1, wherein said indentations, said first and second wafers, said springs and said riveting plates are disposed on one side or on both sides of the cylindrical shaft of the cylinder.

* * * * *